United States Patent [19]

Wada

[11] 4,432,911

[45] Feb. 21, 1984

[54] VARIABLE VENTURI CARBURETOR

[75] Inventor: Satomi Wada, Obu, Japan

[73] Assignee: Aisan Kogyo Kabushiki Kaisha, Japan

[21] Appl. No.: 372,862

[22] Filed: Apr. 28, 1982

[30] Foreign Application Priority Data

Jun. 10, 1981 [JP] Japan ..... 56-89892

[51] Int. Cl.[3] ..... F02M 9/06

[52] U.S. Cl. ..... 261/44 C; 261/DIG. 81

[58] Field of Search ..... 261/44 C, DIG. 81

[56] References Cited

U.S. PATENT DOCUMENTS

| | | | |
|---|---|---|---|
| 3,741,551 | 6/1973 | Hammerschmied | 261/DIG. 39 |
| 4,341,723 | 7/1982 | Hirosawa | 261/44 C |
| 4,369,749 | 1/1983 | Sugi | 261/44 C |

FOREIGN PATENT DOCUMENTS

| | | | |
|---|---|---|---|
| 54-30321 | 3/1979 | Japan | 261/DIG. 81 |
| 2030229 | 4/1980 | United Kingdom | 261/44 C |

*Primary Examiner*—Tim R. Miles

*Attorney, Agent, or Firm*—Blair, Brown & Kreten

[57] ABSTRACT

A variable venturi carburetor including a fuel bypass duct bypassing the fuel metering portion of the fuel jet, the fuel jet being provided with an opening at its upper portion which opening is in opposed relation with the inlet of the fuel bypass duct for easily delivering fuel bubbles created in the fuel jet and also provided with a fuel inlet at its lower portion which is so constructed as for fuel to readily flow into the fuel jet.

7 Claims, 9 Drawing Figures

VARIABLE VENTURI CARBURETOR

BACKGROUND OF THE INVENTION

This invention relates to a variable venturi carburetor for an internal combustion engine, and more particularly to the variable venturi carburetor which prevents the influence of fuel bubbles created during engine running operation, especially under a heavy load condition so as to attain the stablization and improvement of engine power.

In a traditional variable venturi carburetor, especially during engine running operation under a heavy load condition, the atomized fuel stored in a fuel well of a fuel jet installed in the carburetor is vaporized to create fuel bubbles under the influence of vibration or pulsation of the engine, or increase in engine temperature. Such fuel bubbles are filled in the fuel well and intermittently delivered from a fuel metering portion of the fuel jet. As the result, an air-fuel ratio disadvantageously varies and the preset air-fuel ratio cannot be maintained constant for each engine running operation, or the drivability is likely to deteriorate during an engine running operation under a heavy load condition (see FIG. 7).

SUMMARY OF THE INVENTION

Accordingly, a primary object of the present invention is to provide a variable venturi carburetor for an internal combustion engine which prevents fuel bubbles created in the fuel well of the fuel jet from being filled therein especially during engine running operation under a heavy load condition, so that the fuel bubbles are readily delivered from the fuel jet without influencing the fuel metering portion.

Another object of the present invention is to provide a variable venturi carburetor for an internal combustion engine which maintains an air-fuel ratio at a constant value to attain the stabilization and improvement of engine power especially during engine running operation under a heavy load condition.

According to the present invention, the variable venturi carburetor includes a fuel bypass duct bypassing the fuel metering portion of the fuel jet. The fuel jet is provided with a slit at its upper portion which slit is in opposed relation with the inlet of the fuel bypass duct for easily delivering fuel bubbles created in the fuel jet, and also provided with a fuel inlet at its lower portion which is so constructed as for fuel to readily flow into the fuel jet. A bubble well is provided between the outer circumference of the fuel jet and the inner circumference of the fuel passage and is adapted to lead from the slit to the inlet of the fuel bypass duct.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS

Figure 1:
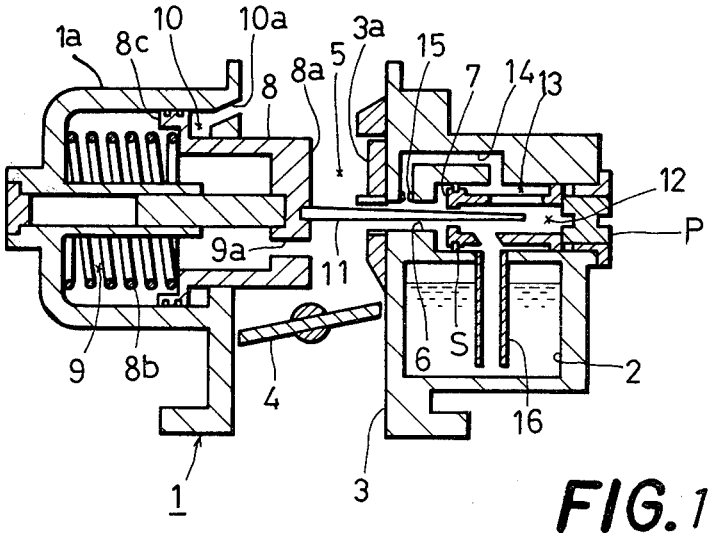
FIG. 1 is a vertical sectional view of the variable venturi carburetor according to the first preferred embodiment of the invention.

Referring now to FIG. 1, reference numeral 1 designates a carburetor body having a float chamber 2, an air intake passage 3, a throttle valve 4 and a venturi portion 5. Reference numeral 6 designates a fuel passage communicating with the float chamber 2 and the venturi portion 5. There is provided a fuel jet 7 in the fuel passage 6. The venturi portion 5 is defined upstream of the throttle valve 4 by the inside wall **3*a* of the air intake passage 3 and the bottom end 8*a* of a suction piston 8. A suction chamber 9 is defined by a cylindrical portion 1*a* of the carburetor body 1 and the suction piston 8 slidably inserted into the cylindrical portion 1*a*. A compression spring 8*b* is inserted in the suction chamber 9 and serves to at all times urge the suction piston 8 toward the inside wall 3*a* of the air intake passage 3. A vacuum communication port 9*a* is provided at the bottom end 8*a* of the suction piston 8 and adapted to communicate with the suction chamber 9 and the venturi portion 5. An atmospheric pressure chamber 10 is defined by the sliding flange portion 8*c* of the suction piston 8 and the carburetor body 1, and provided with an atmospheric pressure communication port 10*a* in the vicinity of the inlet of the air intake passage 3, whereby ambient air is induced through the port 10*a*. A fuel metering needle 11 is fixed to the bottom end 8*a* of the suction piston 8 at its center position. The free end of the fuel metering needle 11 is laterally reciprocatingly inserted in the interior of the fuel jet 7**.

Figure 2:
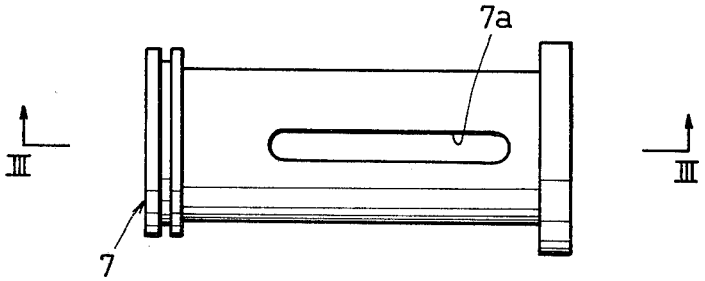
FIG. 2 is a top plan view of the fuel jet as shown in FIG. 1.
Figure 3:
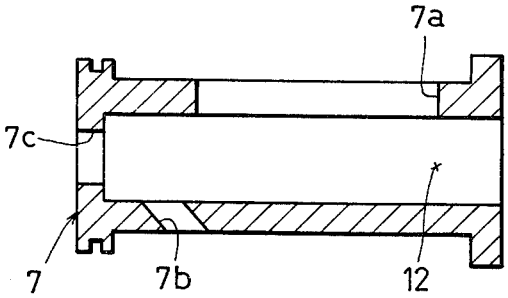
FIG. 3 is a sectional view of the fuel jet taken along the line III—III of FIG. 2.

As shown in FIGS. 2 and 3, the fuel jet 7 is of hollow cylindrical shape and provided with a slit **7*a* at the upper portion thereof. The slit 7*a* is opened longitudinally of and near the right end of the fuel jet 7. The fuel jet 7 is also provided with a fuel inlet 7*b* at the lower portion thereof. The fuel inlet 7*b* is obliquely opened toward the left end of the fuel jet 7. The fuel jet 7 is also provided with a fuel metering portion 7*c* at the left end thereof. The right end of the fuel jet 7 is closed by a plug P, whereby a fuel well 12 is defined in the interior of the fuel jet 7. As shown in FIG. 1, the fuel jet 7 is housed in the fuel passage 6 with a seal ring S fitted on the outer circumference of the left end of the fuel jet 7, whereby a bubble well 13 is defined between the outer circumference of the fuel jet 7 and the inner circumference of the fuel passage 6. The bubble well 13 communicates the slit 7*a* with an inlet of a fuel bypass duct 14**.

The fuel bypass duct 14 bypasses the fuel metering portion **7*c* of the fuel jet 7 above the fuel passage 6. The inlet of the fuel bypass duct 14 opens to the upstream portion of the fuel passage 6 and the outlet of the fuel bypass duct 14 opens to the downstream portion of the fuel passage 6, which outlet is provided with a calibrated jet nozzle 15. The fuel pipe 16 installed in the float chamber 2 is positioned directly beneath the fuel inlet 7***b* of the fuel jet 7.

Figure 4:
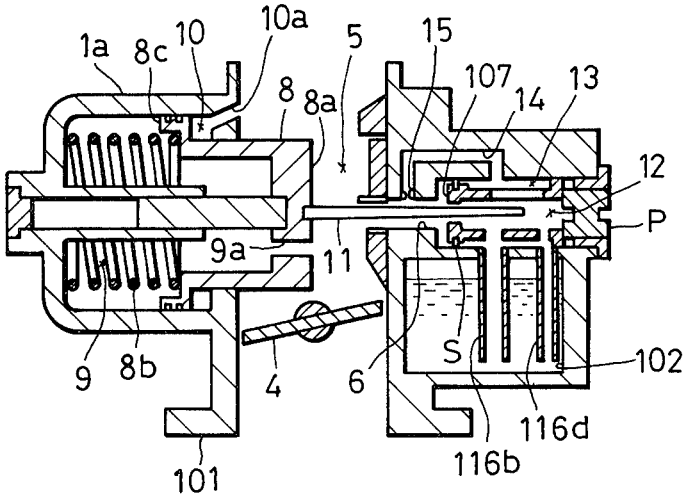
FIG. 4 is a vertical sectional view of the variable venturi carburetor according to the second preferred embodiment of the invention.
Figure 5:
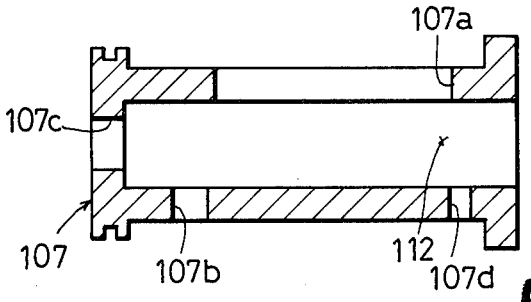
FIG. 5 is a vertical sectional view of the fuel jet as shown in FIG. 4.

FIGS. 4 and 5 show a second preferred embodiment according to the present invention, in which like reference numerals designate identical parts with the first preferred embodiment. In this embodiment, a carburetor body 101 is provided with a fuel jet 107 which has two fuel inlets 107*b* and 107*d* as shown in FIG. 5. Two fuel tubes 116*b* and 116*d* are installed in a float chamber 102 directly beneath the fuel inlets 107*b* and 107*d* and in alignment with the same, respectively. Other components of this embodiment are substantially identical with that of the first preferred embodiment, and therefore the explanation thereof will be omitted.

Figure 6:
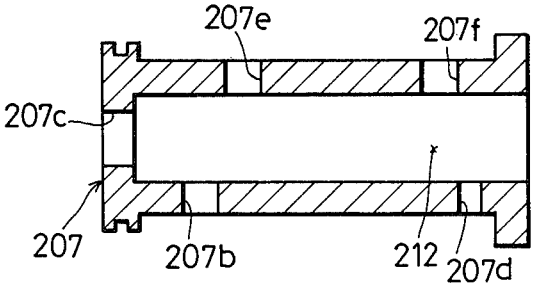
FIG. 6 is a vertical sectional view of the fuel jet according to the third preferred embodiment of the invention.

FIG. 6 shows a fuel jet 207 of a third preferred embodiment according to the present invention, in which the fuel jet 207 is provided with two fuel inlets 207*b* and 207*d*, and two openings 207*e* and 207*f* which are substituted for a slit 7*a* or 107*a* of the preceding preferred embodiments.

Figure 7:
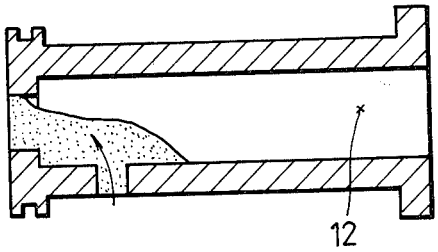
FIG. 7 is a vertical sectional view of the fuel jet in the prior art illustrating the operation thereof.
Figure 8:
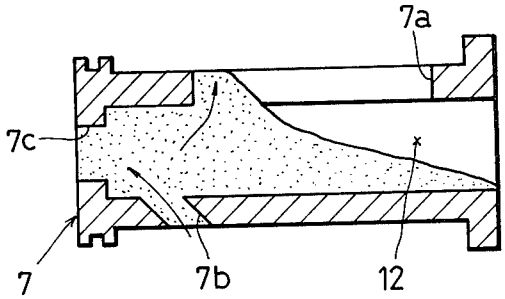
FIGS. 8 and 9 are vertical sectional views of the fuel jets according to the preferred embodiments of the invention illustrating the operation thereof.

In operation, during engine running operation under a heavy load condition, liquid fuel in the float chamber 2 is sucked up through the fuel pipe 16 into the fuel inlet 7*b* of the fuel jet 7. Such sucked fuel is directly supplied to the fuel metering portion 7*c*, the annular opening area of which is controlled by the fuel metering needle 11, or such sucked fuel is once stored in the fuel well 12 and thereafter supplied to the fuel metering portion 7*c*. Such metered fuel is injected through the fuel passage 6 to the venturi portion 5 of the air intake passage 3. Some of the fuel stored in the fuel well 12 is supplied through a bubble well 13 into the fuel bypass duct 14 and then metered by the calibrated jet nozzle 15 to be injected through the fuel passage 6 to the venturi portion 5 of the air intake passage 3. During engine running operation under a heavy load condition, the fuel stored in the fuel well 12 is vaporized, thereby causing bubbles of the vaporized fuel to be generated and stored in the fuel well 12 due to vibration or pulsation of the engine, or increase in engine temperature as referred to FIG. 7 illustrating a conventional fuel jet. On the contrary, since the fuel jet 7 of this preferred embodiment is provided with a slit 7*a* at its upper portion, the fuel bubbles stored in the fuel well 12 are continuously sucked up through the slit 7*a* to the bubble well 13, and then introduced via the fuel bypass duct 14 into the fuel passage 6. The fuel bubbles delivered from the fuel bypass duct 14 are mixed with the metered fuel delivered from the fuel metering portion 7*c* and the mixed fuel is then injected into the venturi portion 5 of the air intake passage 3 as referred to FIG. 8. Since the fuel inlet 7*b* of the fuel jet 7 in this preferred embodiment is constructed as a parallelogram configuration in its longitudinal cross-section, fuel flow toward the fuel metering portion 7*c* is hardly influenced by the fuel bubbles stored in the fuel well 12. Accordingly, the rate of fuel flow is properly metered by the fuel metering portion 7*c* of the fuel jet 7 to maintain a constant air-fuel ratio without being influenced by the fuel bubbles in the fuel well 12.

Figure 9:
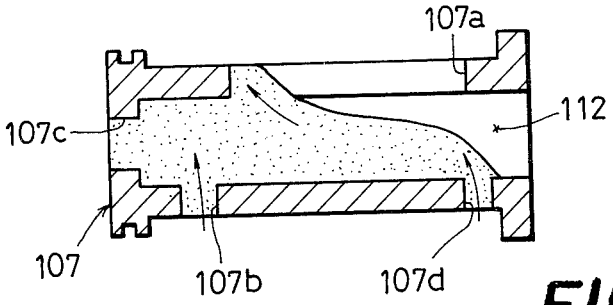

The operation of the second preferred embodiment as shown FIG. 4 is featured such that the fuel in the float chamber 102 is sucked up via two fuel pipes 116*b* and 116*d* through two fuel inlets 107*b* and 107*d* into the fuel well 112, thereby causing the fuel flowing into the fuel well 112 to successively flow out and also reducing creation of the fuel bubbles as referred to FIG. 9.

Although some preferred embodiments of the invention have been disclosed and described, it is apparent that other embodiments and modifications of the invention are possible within the scope of the appended claims.

What is claimed is:

1. In combination with a variable venturi carburetor for an internal combustion engine having a float chamber, an air intake passage, a venturi portion provided in said air intake passage, a fuel passage communicating with said float chamber and said venturi portion, a fuel jet provided in said fuel passage, a suction piston adapted for reciprocation across said venturi portion in response to the load conditions of the engine, and a fuel metering needle fixed to a bottom end of said suction piston at its base portion for controlling an annular opening area of a fuel metering portion of said fuel jet by the reciprocation of a free end of said needle;

the improvement comprising a fuel bypass duct provided above said fuel passage and adapted for bypassing said fuel jet to communicate between upstream and downstream positions of said fuel passage, said fuel bypass duct having a calibrated jet nozzle at its outlet, said fuel jet being formed in substantially hollow cylindrical configuration, a slit provided on said fuel jet and oriented for leading to an inlet of said fuel bypass duct, a fuel inlet provided at the lower portion of said fuel jet and adapted for leading to said float chamber, and a bubble well provided between the outer circumference of said fuel jet and the inner circumference of said fuel passage and adapted for leading from said slit to said inlet of said fuel bypass duct.

2. The variable venturi carburetor as defined in claim 1 wherein said fuel inlet is formed as a parallelogram in its longitudinal cross-section.

3. The variable venturi carburetor as defined in claim 1 wherein said fuel inlet comprises at least two throughholes.

4. The variable venturi carburetor as defined in claim 1 wherein said fuel jet is embodied as an elongate cylinder of uniform cross-section up to end portions of said jet, one end portion having a flanged periphery dimensioned to an inner diameter of said fuel passage, and another end portion adjacent said fuel metering portion having a flanged periphery including an annular groove, and a gasket seal disposed in said groove to prevent communication of said bubble well therebeyond.

5. The variable venturi carburetor as defined in claim 1 wherein said slit is disposed in a longitudinal direction along said fuel jet adjacent said inlet of said fuel bypass duct.

6. The variable venturi carburetor of claim 4 wherein a pair of slits are provided on said fuel jet.

7. The variable venturi carburetor of claim 1 wherein said fuel inlet is upstream of said fuel metering portion.

* * * * *